US006874783B2

(12) United States Patent
Higginson

(10) Patent No.: US 6,874,783 B2
(45) Date of Patent: Apr. 5, 2005

(54) SINGLE GAME VARIANT OF ACCUMULATION LOTTO

(75) Inventor: Henry C. Higginson, Wimberley, TX (US)

(73) Assignee: Trace Publishing Company, Wimberley, TX (US)

( * ) Notice: Subject to any disclaimer, the term of this patent is extended or adjusted under 35 U.S.C. 154(b) by 0 days.

(21) Appl. No.: 10/639,110

(22) Filed: Aug. 12, 2003

(65) Prior Publication Data

US 2004/0032084 A1 Feb. 19, 2004

Related U.S. Application Data

(63) Continuation-in-part of application No. 10/280,981, filed on Oct. 25, 2002

(60) Provisional application No. 60/343,293, filed on Oct. 26, 2001, and provisional application No. 60/360,558, filed on Feb. 26, 2002.

(51) Int. Cl.[7] ..... A63F 3/06

(52) U.S. Cl. ..... 273/269; 273/139; 463/17

(58) Field of Search ..... 273/139, 269, 273/270; 283/901, 903; 463/16, 17, 18, 19

(56) References Cited

U.S. PATENT DOCUMENTS

| | | | | | |
|---|---|---|---|---|---|
| 5,158,293 | A | | 10/1992 | Mullins | |
| 5,273,281 | A | | 12/1993 | Lovell | |
| 5,393,057 | A | * | 2/1995 | Marnell, II | 463/13 |
| 5,407,200 | A | | 4/1995 | Zalabak | |
| 5,647,798 | A | * | 7/1997 | Falciglia | 463/19 |
| 5,651,735 | A | * | 7/1997 | Baba | 463/18 |
| 5,743,524 | A | | 4/1998 | Nannicola | |
| 5,772,511 | A | | 6/1998 | Smeltzer | |
| 5,979,894 | A | * | 11/1999 | Alexoff | 273/139 |
| 6,086,477 | A | * | 7/2000 | Walker et al. | 463/17 |
| 6,099,407 | A | * | 8/2000 | Parker et al. | 463/19 |
| 6,102,400 | A | * | 8/2000 | Scott et al. | 273/269 |
| 6,325,716 | B1 | | 12/2001 | Walker et al. | |
| 6,386,975 | B1 | | 5/2002 | Peterson | |
| 6,416,408 | B2 | | 7/2002 | Tracy et al. | |
| 6,497,408 | B1 | | 12/2002 | Walker et al. | |
| 6,599,186 | B1 | * | 7/2003 | Walker et al. | 463/17 |
| 6,709,331 | B2 | * | 3/2004 | Berman | 463/16 |
| 2001/0034262 | A1 | | 10/2001 | Banyai | |
| 2003/0045338 | A1 | | 3/2003 | Dolloff et al. | |
| 2004/0032084 | A1 | * | 2/2004 | Higginson | 273/269 |

* cited by examiner

*Primary Examiner*—William M. Pierce
(74) *Attorney, Agent, or Firm*—Monty L. Ross; Mark R. Backofen; Locke Liddell & Sapp LLP

(57) ABSTRACT

A variation of a lottery-type game of chance where each drawing is not only a stand-alone event, but each entry is also valid for a defined number of accumulation rounds. The numbers selected for the entry are then compared to a predefined number of consecutive drawings. The total number of matches (or "hits") during all of these accumulation rounds is used to determine if the entry is a winner. This variation can be conducted alongside the standard lottery-type game without interference and entries can begin and end their accumulation period at different times during the duration of the game. Preferably each entry in the underlying game is a separate entry in the accumulation game and there is a single entry fee to add the accumulation option to a game slip regardless of the number of entries present on the game slip.

19 Claims, 7 Drawing Sheets

REG. LOTTO DRAWS
WEEK 8
WEEK 9
WEEK 10
WEEK 11
WEEK 12
WEEK 13
WEEK 14
15 16 17 18 19 20 21 22 23 24 25 26 27 28
TOTAL ENTRIES BEING TRACKED (IN MILLIONS)
THIRD GROUP
FOURTH GROUP

REG. LOTTO DRAWS
WEEK 15
WEEK 16
WEEK 17
WEEK 18
WEEK 19
WEEK 20
WEEK 21
WEEK 22
TOTAL ENTRIES BEING TRACKED (IN MILLIONS)
FIFTH GROUP
SIXTH GROUP

SINGLE GAME VARIANT OF ACCUMULATION LOTTO

CROSS REFERENCE TO RELATED APPLICATIONS

This application is a continuation-in-part of prior application Ser. No. 10/280,981, now U.S. Pat. No. 6,793,219, filed Oct. 25, 2002, which is based upon and claims priority to the inventor's Provisional Patent Application No. 60/343,293 entitled "Triple Win Accumulation Keno," filed Oct. 26, 2001 as well as Provisional Patent Application No. 60/360,558 entitled "Unique and Original Variation in Format for Lottery-Style Games of Chance," filed on Feb. 26, 2002.

BACKGROUND OF THE INVENTION

1. Field of the Invention

This invention relates generally to games of chance predicated on the selection of numbers and, more particularly, to an accumulation variant of lottery-style games of chance.

2. Description of Related Art

All games of chance based upon the selection of numbers, such as Keno and state run lotteries, operate on the same basic procedures. Players pick a set of numbers, submit a play slip with the required fee, and receive an official ticket to confirm their entries. The set of numbers is good for only the single game or drawing that is identified on the ticket. At a designated later time, a group of numbers are randomly drawn and become the official winning numbers. Depending on whether the player's numbers match at least a predetermined amount of the winning numbers, he or she may be a winner. A variation on this is that a player can pre-pay to play the same set of numbers for multiple consecutive games or drawings. The entry is then valid for the selected number of consecutive individual games or drawings. It is as if the player purchased a number of separate entries, selecting the same set of numbers on each entry. There are several significant variations based upon this common platform.

In one variation, commonly called Keno, there are a number of different playing options available, thereby providing the player a choice of the amount of the wager for each ticket. Players can choose from a wide range of games, involving the selection of from only one or two numbers to often as many as twenty, all from the same pool of eighty numbers in play during each drawing. The prize threshold amount depend entirely upon the Keno game chosen and are determined ahead of time by the casino and are based upon the payout policies and the probability of winning. Each Keno location is independent and has its own fixed payment tables to determine prize amounts based upon the Keno game and number of correct matches.

The wide variety of games available in Keno, results in an increased amount of information that must be manually entered into the system computer before an official ticket can be printed and the entry activated. Consequently, there is a larger staff requirement and increased interaction between the players and staff, who are often referred to as "Keno Writers". The high staffing requirements mean that a large jackpot win can, and often does, drain most or all of the profits from the Keno game for a considerable period. Since the number of tickets that one Keno Writer can issue, even with the aid of computerization, is constant, attempts to increase the number of tickets sold will not necessarily increase the casino's revenue or profits from the game.

Another variation of number based games of chance is a lottery, such as the ones operated by various states. Players generally have only a single play mode with a fixed price for each entry, generally one dollar. This lack of choice allows many remote locations to be linked together in a single lottery game without the need for a large dedicated staff to run the game. The prize payouts are generally pari-mutuel except for the lower payouts, which are fixed in much the same way as in Keno. This means that the major prize levels are calculated based on a percentage of the total amount wagered by all participants in each drawing. If there is no winner, the proceeds are often carried over to the subsequent drawing, thereby increasing the "pot" of funds available for the top prize levels of the subsequent drawing. As a result, the sale of lottery tickets fluctuate based upon the estimated jackpot size.

In some cases the distinction between the lottery and Keno variations is being blurred. State run lotteries have recently been introducing new promotions and games to increase revenues and lure more players. Games such as "Texas Millions" completely dispense with the pari-mutuel system of variable jackpots and set fixed amounts for all prize levels, irrespective of the total amount wagered by all participants. Texas Millions involves multiple sets of numbers issued for a single entry and the prize amount varies depending on which set contained the winning numbers. Other games have added features that allow players to pick "bonus numbers" thereby making the game more like the variable number situation of Keno. However, even these hybrid games still follow the same basic premise of all prior games of chance based upon the selection of numbers.

This basic premise is that each drawing is a stand-alone event. After the official numbers are drawn, the entries for that particular draw go "dead." A player may have pre-paid for use of the same numbers in multiple consecutive draws, in which event the same numbers will stay alive for a series of identical, one-time events. However, this is the same as purchasing a number of entries and selecting the same set of numbers for each one. In any event, none of the prior games of chance based upon the selection of numbers involves the accumulation of matches over a number of games or drawings.

SUMMARY OF THE INVENTION

A new variant of a game of chance based upon the selection of numbers, where each entry would, in addition to the traditional single drawing, be valid in an accumulation mode for multiple additional drawings. A player purchases an entry in the normal manner and pays an additional fee to add the accumulation option to his or her entry. The entry is valid for the single or multiple game or drawing as a traditional entry would be and in the same manner. In addition, the entry is also valid for an additional defined number of games or drawings, which may include the original drawing, in an accumulation mode. Preferably, each entry is independent of all other entries and can start on any ordinary drawing during the course of the game without affecting the length of the accumulation period. During these additional drawings, the number of matches between the entry and the official winning numbers for each drawing are added together to obtain a total number of matches. If the entry can be a variable length of numbers, such as in Keno, the accumulation total is the ratio between the total number of matches and the number of numbers selected in the entry. If the entry is of a defined length of numbers, such as a standard lottery game, the number of matches is the accumulation total. If the accumulation total is above a set threshold at the end of the additional drawings, the player is a winner. Preferably, there would be a second and third prize level for the entries with the highest accumulation total during set periods, such as the month for the second level and the year for the third level. In a preferred embodiment, each entry in the underlying game is a separate entry in the accumulation game and there is a single entry fee to add the accumulation option to a game slip regardless of the number of entries present on the game slip.

BRIEF DESCRIPTION OF THE DRAWINGS

The invention is further described and explained in relation to the following drawings, wherein.

DETAILED DESCRIPTION OF THE PREFERRED EMBODIMENT

Figure 1A:
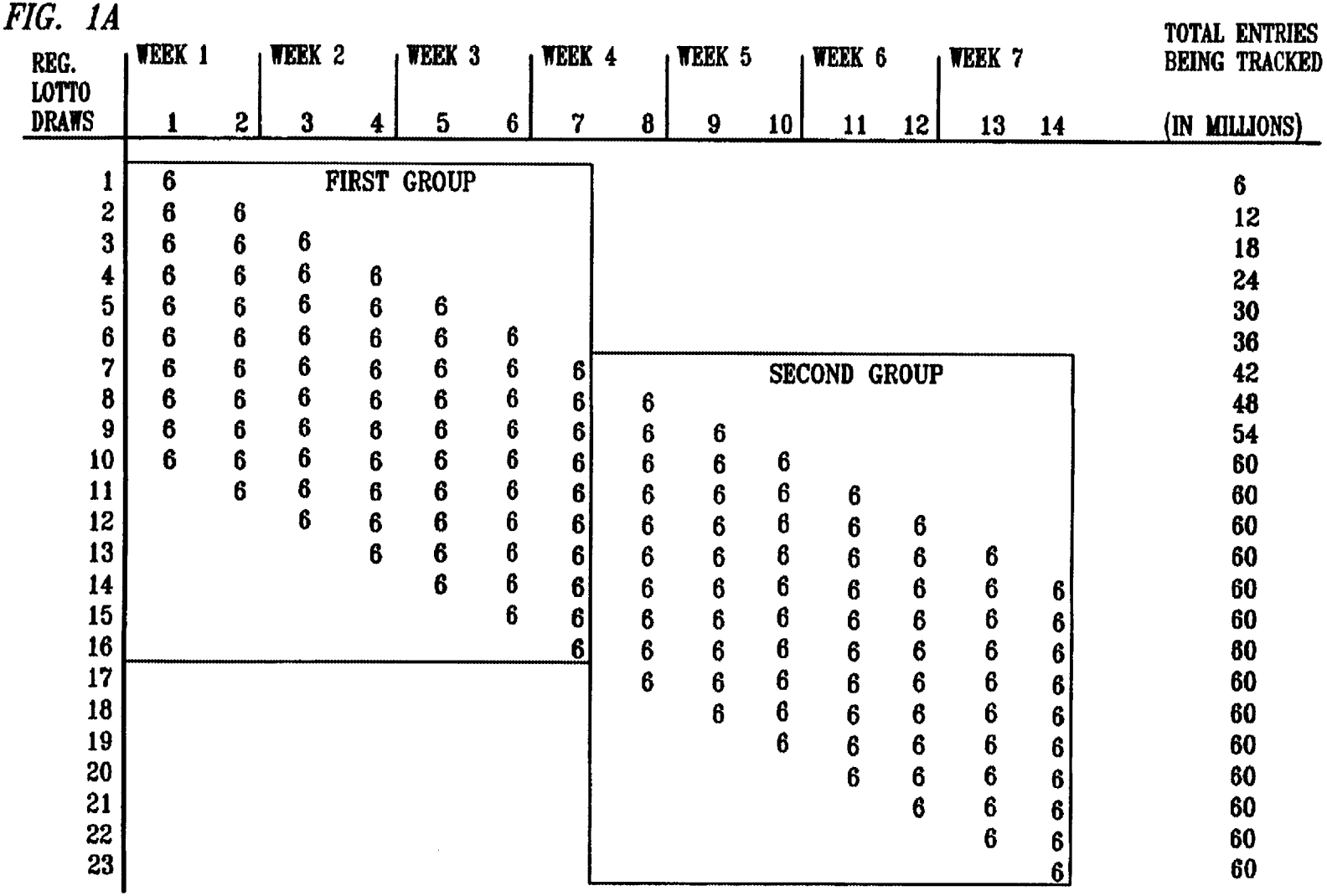
FIG. 1A is a portion of a table of an example of Single Game Module Accumulation Lotto depicting the accumulation periods making up the first and second groups.

The following description will describe the embodiments of the current invention that are preferred under the stated circumstances. Mathematically, there is an enormous number of permutations of the current invention that could be implemented. Currently, there is no one embodiment that is viewed by the inventor as being superior in all situations. The specific game parameters depend upon at least the following, the number of play variations available to the player (as in Keno) if more than one (as in most lotteries), the size of the expected player pool, the percentage of revenues that will be paid out as prizes, the desired overall length of the competition cycle, and the pool of numbers available. The payout table and other characteristics of the game can be determined in a manner known to those of skill in the art based upon these particular circumstances.

A first embodiment is for use in a typical casino Keno lounge and is referred to as "Accumulation Keno". For an additional fixed fee players can add the Accumulation Keno option to any or all of their regular Keno tickets. It does not matter how much the original wager was for or how many numbers were picked for the entry. If the ticket is a winner during the traditional drawing, the Keno Writer will make a copy of the winning ticket as is common in Keno establishments, issue the winnings to the player, and return the ticket or the official facsimile to the player for the accumulation rounds. The single traditional drawing for which the ticket was purchased may also be the first game in the accumulation mode. For the next defined number of drawings, all matches from each drawing are added together to obtain a total. The accumulation total is calculated as the ratio between the total number of matches (or "hits") to the size of the original set of numbers selected by the player. That accumulation total is compared to a payout chart to determine if it is a winner and therefore a Qualifier for the second and third rounds.

The payout chart would be based upon the ratio of the number of matches made during the accumulation rounds to the number of numbers that were selected on the entry ticket. This can be accomplished through a payout table that has the number of matches along the top and the size of the player's original set along the side. Where the column meets the row, is the amount of the prize won for that particular ratio. For example, if there were a total of 60 matches and the player originally selected 20 numbers, the accumulation total would be 60:20. By looking at the column labeled 60 and following it down until it intersected with the row labeled 20, the player would see the amount of the prize that was won, if any. In this way, the amount of the prize can be higher for higher accumulation ratios, due to the lower probability of a player reaching those higher ratios. Preferably, at least 15% of the total prize money available would be distributed to first level winners, or qualifiers, during the course of the entire game cycle.

For example, if six numbers were selected on the entry and the accumulation round was six drawings long, the maximum possible number of matches, sometime called a "Grand Slam", would be 36. In this case, the threshold for qualifying could be anywhere from as low as twelve (12) to as high as eighteen (18), depending upon the payout rate and the prize level desired by the casino. The lower the threshold to qualify, the more entries would be sold along with a higher payout rate. Therefore, the qualifying threshold and the payout amount can be altered by the casino operator to achieve the largest draw of players while maintaining a desired payout ratio.

In addition, all Qualifiers would be automatically eligible for the Second Tier Prizes. This could be for, say, five Qualifiers with the highest accumulation ratio on a single entry during each calendar month. This prize is a guaranteed distribution each month to the entries with the highest accumulation ratios regardless of the overall level of accumulation ratios that month. The advantage of allowing only the Qualifiers to be considered for the second round prize is that only Qualifier tickets need to be kept in the computer system storage after the end of the accumulation period for each entry. As long as there are at least five Qualifiers each month, there would be no way any non-qualifier would be able to win any of the monthly prizes. The prize payout for this Second Tier Prize could range from one thousand ($1,000) to five thousand dollars ($5,000), for the winner, with lesser amounts for the runners-up.

All monthly prize winners would then become further eligible for a group of Third Tier prizes, including a Grand Prize, at the end of the game, which may be a calendar year. The Grand Prize may be in the form of a progressive jackpot with an attractive minimum starting point or a preset amount ranging for example from fifty thousand ($50,000) to five million dollars ($5,000,000). Only the winners of the monthly prizes would be considered for the grand prize, so only monthly winning tickets need necessarily be stored after the respective monthly drawing.

The payout schedule is generally based upon mathematical modeling of probabilities to conform to the payout policies of the casino, in the same way the standard payout table is generated for traditional Keno games. Simple standard mathematical calculations can be used to determine the probability of winning based upon the number of number selected, the size of the Keno pool (i.e. the numbers that can be chosen, typically 1–80), the number of winning numbers selected each round (typically 20) and the number of accumulation rounds. For example, in an 80 number pool, and with 20 numbers selected each round as winners, there is a 25% chance that any one particular number will be picked in that round. However, there is only a 6.25% chance that two chosen numbers will both be picked in the same round. The chance of having those two numbers picked in either of two rounds is back to 25%.

In this way the number of accumulation rounds, payout thresholds, and payout amounts are chosen so that over the long run the likely total payout would be the desired percentage of the revenues taken in from the game according to the casino's payment policies. The sum of the prize amount times the probability of that outcome for each possible outcome is calculated. This yields the average payout per player. The game parameters and prize amounts can be adjusted until the total expected payout is the desired percentage of the cost of adding the accumulation option. The ranges of the second and third prize levels can be calculated in a similar manner as a percentage of total expected revenue.

Thus a particular Accumulation Keno game might look like the following. It is assumed for present purposes that the desired First Tier payout rate for all qualifiers is 25% of revenue. A traditional Keno game involving a pool of 80 numbers with 20 numbers selected each game is used and the accumulation period is 10 drawings. In a casino that sells 3,000,000 regular Keno tickets each year, on the basis of just one in three players adding the accumulation mode to the regular ticket play, one million (1,000,000) accumulation tickets would be sold during the calendar year duration of the game. With the accumulation game costing an additional $1 per entry, there is an estimated one million dollars ($1,000,000) in revenue for the entire game. For a ticket where eight (8) numbers were selected ("8 spot"), the qualifying threshold may be set at 31 matches or hits; for a ten (10) spot ticket, that threshold may be 39. With an expectation that approximately 415 tickets in all will be winners each month, depending on casino payout policy, the qualifying prize for the First Tier Level, irrespective of the regular game played, may be set at fifty dollars ($50), to return 25% of the total pool back to Qualifiers as First Tier prizes.

The amount of this First Tier prize does not vary with the number of hits on the ticket, but the greater the number of hits, the greater the chance that a qualifying ticket will win one of the Second Tier prizes and qualify for the opportunity to win one of the major Third Tier prizes that are payable at the end of the game.

If the payout for all of the monthly Second Tier prizes during the game is set at 12% of the revenue from the same wager pool, there would be ten thousand dollars ($10,000) available each month for distribution to the selected number of monthly Second Tier prize winners, selected from ALL Qualifiers that month on the basis of the highest ratio of matches achieved during their respective accumulation periods. In this example, the win amounts would be preset at five thousand dollars ($5,000) for the Qualifier(s) with the highest ratio of hits, two thousand dollars ($2,000) for second place, and three prizes of one thousand dollars ($1,000) for Qualifiers with the next three highest ratios. Since it is theoretically possible that more than one ticket could achieve the same hit ratio, then in such an event, the prize would be shared among those tickets achieving that ratio.

The minimum Grand Prize, and any lesser Third Tier Prizes that are payable at the end of the year long game, are set at an additional 10% of the revenue. The Third Tier Prizes could be set at a minimum guarantee of fifty thousand dollars ($50,000) for the Grand Prize, irrespective of the ratio of hits achieved, and an additional fifty thousand dollars ($50,000) to be distributed among the other end-of-game Third Tier winners. However, should the casino offer a bonus payout to the Grand Prize Winner, depending upon the accumulation ratio of the winning ticket, the total payout to the Grand Prize Winner in our Accumulation Keno model could escalate from the $50,000 minimum guarantee to as much as one million dollars ($1,000,000) or more. Alternatively, an offering casino may prefer to set a guaranteed minimum Grand Prize but have a progressive jackpot that is payable irrespective of the ratio of winning hits achieved on the winning ticket.

Since the bonus payout, at whatever level, if not covered, could adversely impact the profitability of the game for the casino, it is assumed that the operator would take out insurance to cover the risk of a payout in excess of the minimum Grand Prize guaranteed by the casino. Thus, in our example, the residual gross profit for the casino from the operation of a one year long game would be $430,000 or 43% of the wager pool, less the cost of risk premiums for insurance to cover any bonus payouts to the Grand Prize Winner.

From a player's perspective, the modest additional price of a single dollar added to any regular ticket regardless of the amount of the original wager, extends the life of the ticket and brings three additional and separate winning chances, including two if not all three, chances of winning prizes substantially in excess of what is available, in most cases, from a standard ticket. For example, in most casinos a player with a regular five spot ticket, if all five numbers come up in that single drawing, may win just $500 to $700 for a one-dollar wager. Three matches or hits in that single game at the most may only recover the amount of the wager. For only a single dollar more, that same ticket in accumulation mode could bring him, $50, $5,000, perhaps as much as $1,000,000 or more, and maybe all three.

The simplicity of the system is also an attraction. Players just add up their matches and consult the payoff chart to determine if their ticket is a winner. If the ticket is a winner, the player collects the First Tier prize at the end of the ticket's accumulation period and then can sit back and watch the entry compete with the other Qualifiers for the larger Second and Third Tier Prizes. The impulse to continue adding the extra $1 to all his subsequent regular play tickets is further enhanced by the knowledge that, unlike most casino games, not only the Qualifying First Tier prizes are guaranteed, but the monthly Second Tier and end-of-game minimum, bonus or progressive jackpot Third Tier Grand Prizes are guaranteed and will be paid out to somebody in accordance with the schedule. There is no requirement to hit any preset and virtually impossible target once a ticket has qualified for the subsequent prize tiers.

The advantage of the system from the casino's perspective is that it provides an additional revenue source as opposed to merely shifting income from one game to another. Players will continue to play their usual Keno games but are now able to increase their winning chances by adding the accumulation option to their ticket. This results in a higher average wager made per ticket, increasing revenue without the increased staffing requirement involved with having to issue additional tickets. Revenue is thereby generated without a corresponding increase in costs associated with the sale of additional tickets in traditional Keno games.

Additional hardware, if any, would be minimal and only what may be required to add the accumulation variant to a traditional Keno operation. The simple operating and tracking system that is necessary to add the accumulation option to traditional Keno lounges likely can be fully implemented by the existing standard hardware. A simple program can overlay the current Keno system and be able to extract the relevant information necessary to administer the game. At most a single separate computer may be necessary for record retention and control over any desired additional visual and audio recordings and prompts used to attract and retain players.

The accumulation variant would only require the addition of a few procedures to normal Keno operations. Keno tickets already typically have a start and end game number. A cipher would be added to the entry to designate it an accumulation ticket as well as the number of the last game in the accumulation sequence. This allows different tickets to start and end their accumulation periods at different times. A winning ticket in the traditional drawing(s) is copied by the Keno Writer, the winnings paid to the player, and the ticket is returned until the accumulation sequence is finished. That copy procedure is already a common part of standard Keno operations in casinos where many players wish to retain copies of their tickets for later reference. Copies of tickets would also be issued when collecting the Second Tier prizes. Therefore, there would be little additional training of Keno Writers or development of procedures to implement the accumulation variant to a standard Keno operation.

A second embodiment is directed to applying the invention to a standard lottery game and is referred to as "Accumulation Lotto." Players would purchase the lottery tickets in the same manner currently used by state lotteries. For an additional payment, players can add the Accumulation option to their tickets. The numbers selected remain live through a number of consecutive drawings and accumulate a total number of matches. The accumulation period of various tickets will start and end on different drawings. Entries that amass an accumulation total above a threshold amount would be winners and qualify for the later rounds of prizes.

Monthly prizes are awarded for the qualifying entries, purchased that month, that have the highest accumulated matches compared to the maximum possible matches for the their respective accumulation periods. In addition, Grand Prizes are awarded for those entries that amassed the highest accumulation totals, during their respective accumulation periods, over the course of the entire game, which is preferably a calendar year, though some lottery operators may opt to offer games of shorter duration. Alternatively, the Grand Prizes can be awarded to the player that has the highest accumulation total calculated by adding up all of the qualifying tickets purchased by that player. Unlike traditional tickets where a certain number of correct matches are required to win, it is guaranteed that the major accumulation prizes will be distributed at predetermined intervals for the ticket that has achieved the highest number of accumulated matches.

The lottery agency will determine the duration of the accumulation period as well as the payoff thresholds and payoff amounts. These determinations can be easily made by one of skill in the art based upon the particular circumstances. For example, assuming the local lotto rules permit distribution of 65% of the total wager, an average of four million $1 entries are sold per draw, there are two drawings a week, and a full calendar year game period, there would be a total wager base of $416,000,000 per year. Further assuming that 70% of the tickets are purchased using the maximum number of chances per entry slip, which is typically five, and that the accumulation mode is based upon an additional $1 for each of those entry slips, and that only purchasers of five game entries can add the accumulation option, then the total wager in the separate accumulation pool would be approximately $58 million during the year, of which around $38 million would be available for payments to winners under the local lottery rules.

Under these circumstances, the preferred payout schedule would look something like the following. The accumulation period would be ten draws and would begin with the regular drawing. The accumulation period could also start with the drawing following that for which the regular ticket was purchased if it is considered that winners in the traditional drawing should not be given any "kick-off" advantage in the event they repeat the same numbers in each of the panels.

In a standard six number lottery, depending on whether any numbers are duplicated on the entry slip, there are a maximum of thirty "hit" possibilities for a five-line ticket, for each drawing, resulting in a total of 300 hit chances during the ten game accumulation life of the ticket. The qualification level may be 150 hits during the accumulation period and total payout at this level would be set at about 15% of the total funds available to all winners over the full twelve-month cycle, which is about $5,700,000 in this case. The payout would vary depending upon the probability of reaching the 150 hit threshold, which can be easily calculated based upon the size of the pool of numbers that can be selected. The payout to qualifiers could range from $25 to $250 depending upon the odds of surpassing the threshold number of hits. In addition, the threshold number itself could be adjusted based upon the probabilities in order to provide a desired payout amount and still ensure that sufficient funds remain for the other Qualifiers. Based upon the above example, in a lottery pool of fifty (50) numbers, the payout could be in the $25 to $250 range when the threshold for matches to qualify is set by the lottery operator between sixty-five (65) and eighty-five (85), depending upon the percentage of total payout that the lottery operator reserves for payment at the First Tier Prize level and the likelihood that a player may select the same number several times on a five-line entry slip.

All of the Qualifiers remain in the pool for the guaranteed Second Tier prizes that are distributed monthly. The tickets with the highest number of matches during their respective accumulation periods, which ended in that month would be awarded the monthly prizes. The monthly prize can be awarded entirely to the ticket with the highest number of matches or more preferably, a range of prizes are awarded to the group of tickets that have the highest number of matches. An example of suggested preset prizes would be $250,000 for the monthly winner, $50,000 for second place, $25,000 each for third through fifth places and $5,000 each for the following 25 next highest tickets.

The Third Tier Grand Prizes are awarded at the end of the game, in this case at the end of the year, to the players with the most accumulated hits or matches on a single ticket or, at the option of the lottery operator, who have accumulated the most hits taken from all of the Qualifying accumulation tickets that the player has purchased. The advantage to the later option for the lottery operator is that it would more likely trigger a more consistent flow of repeat entries with every five play entry slip purchased for the regular draws.

The prizes can be awarded on a progressive basis, based upon the total amount that ends up in the separate pool, or they may be preset amounts that are decided at the start of the annual game. An example of preset prizes for the Third Tier, Grand Prize, level is: $25,000,000 grand prize, $500,000 second place, and $250,000 for third through fifth places.

Under the suggested prize schedule, 15% of the available prize fund or about $5,700,000 is distributed to Qualifiers during the entire year. An additional $6,000,000 is distributed as monthly awards during the course of the year, leaving over $26 million for the end of the year awards. The suggested end-of-game Third Tier Grand Prizes add up to $26,250,000, which leaves approximately $50,000 left from the original $38,000,000 available as payouts to all of the winners. This would serve as a small buffer in case more then the average number of tickets qualifies in any particular year.

The proposed accumulation variant would not likely require any additional hardware or require a significant change in the way the lottery game is run. It is likely that the existing system software used by the Lottery Commission, could be adapted to keep track of the accumulating hits of the tickets. Alternatively, a simple storage and retrieval system can be overlaid on the standard system to keep track of and maintain that the necessary information. Storage capacity requirements would be limited to keeping track of only the relatively small number of tickets that remain in contention for the larger prizes beyond each prize level.

Similar to the Keno embodiment, the procedure would only require the addition of a cipher to the ticket to identify it as an accumulation ticket as well as the last drawing of the accumulation period. The lottery ticket already identifies the initial drawing and often has a unique identification code to make it easier for untrained staff to verify if the ticket is a winner. The ticket's identification number can also be linked to inform the ticket staff whether the ticket is a Qualifying ticket after its accumulation period has ended. The only significant change is that the ticket must be marked or a new ticket issued for tickets that are winners during the original drawing.

Several advantages of such an accumulation variation are apparent for the lottery operator. First, the average wager per ticket would be increased, thereby increasing revenue without the need to issue additional tickets. Second, it would provide a separate revenue stream in addition to and that does not replace the original revenue stream from the traditional lottery game. Third, the addition of the accumulation offering has the potential to increase sales especially during periods when the traditional jackpot is low.

The number of lottery tickets sold is in direct proportion to the potential size of the regular single-draw jackpot. During periods when there is no carry-over jackpot from the previous drawing or when the carry over is not very large, there are significantly fewer tickets sold. It is extremely beneficial to the lottery operator to increase sales during these periods. The accumulation variation to the traditional lottery has the potential to achieve increases in sales during times of lower traditional jackpots. This is because the accumulation option gives players a chance to win the guaranteed accumulation prizes that are completely independent of the size of the traditional jackpot and are set at levels to encourage participation no matter how small the regular jackpot. Additionally, the chance of winning the monthly prizes is somewhat higher during months where fewer tickets are sold.

This accumulation variation is also an attractive option for the players as well. It does not alter in any way their ability to play the traditional lottery. It is also convenient, for a modest additional fee, to be able to extend the life of their numbers for an additional number of drawings. This provides players with additional method of winning based upon the single ticket purchased. It also can add to the excitement of the drawings without the player having to purchase tickets for each drawing. Finally, these benefits are available for all purchased tickets and does not depend on the time or date that the accumulation ticket was purchased.

Figure 2A:
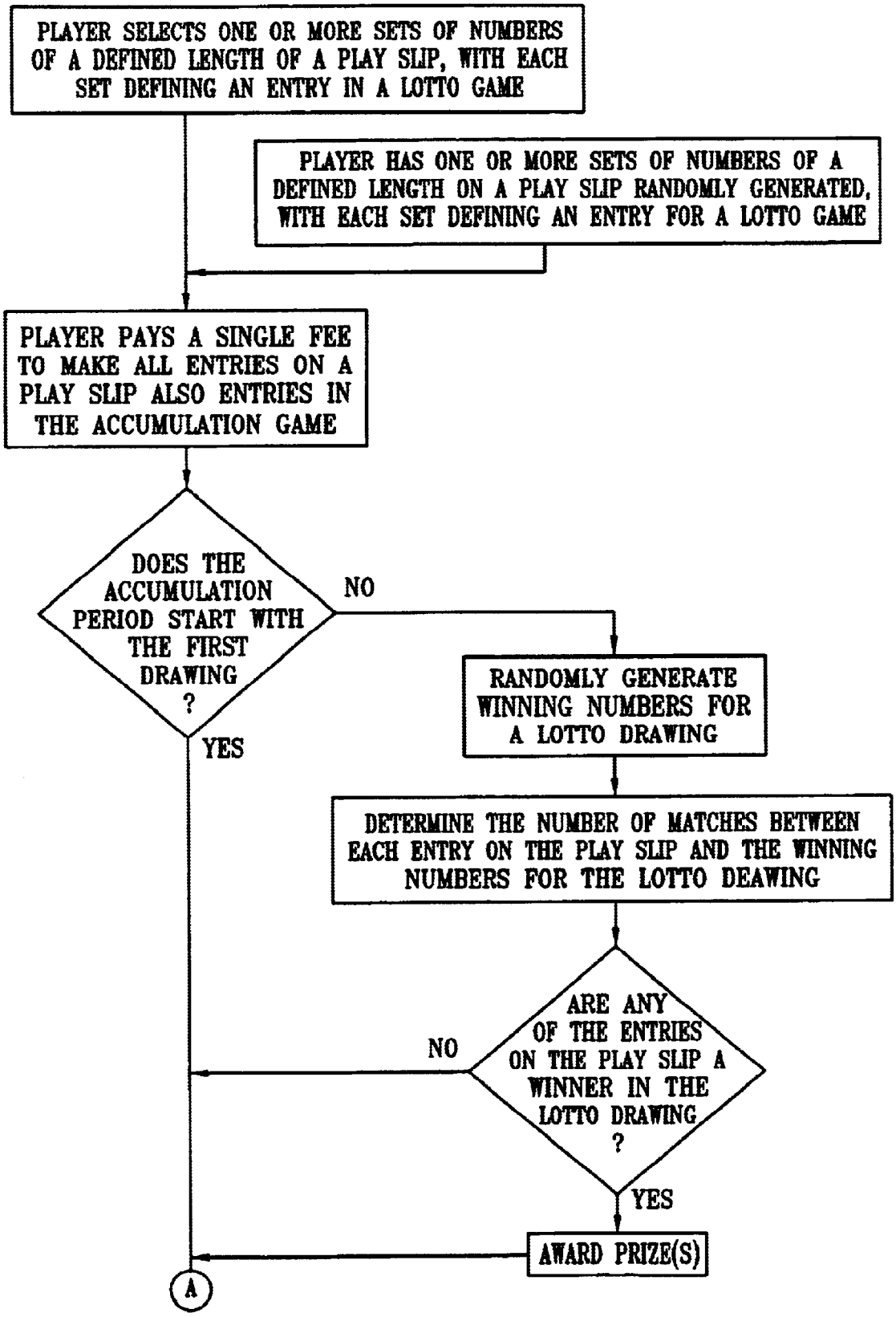
FIGS. 2*a* through 2*c* is a flow chart depicting an embodiment of the current invention where the invention is applied in the context of a lotto game.
Figure 2B:
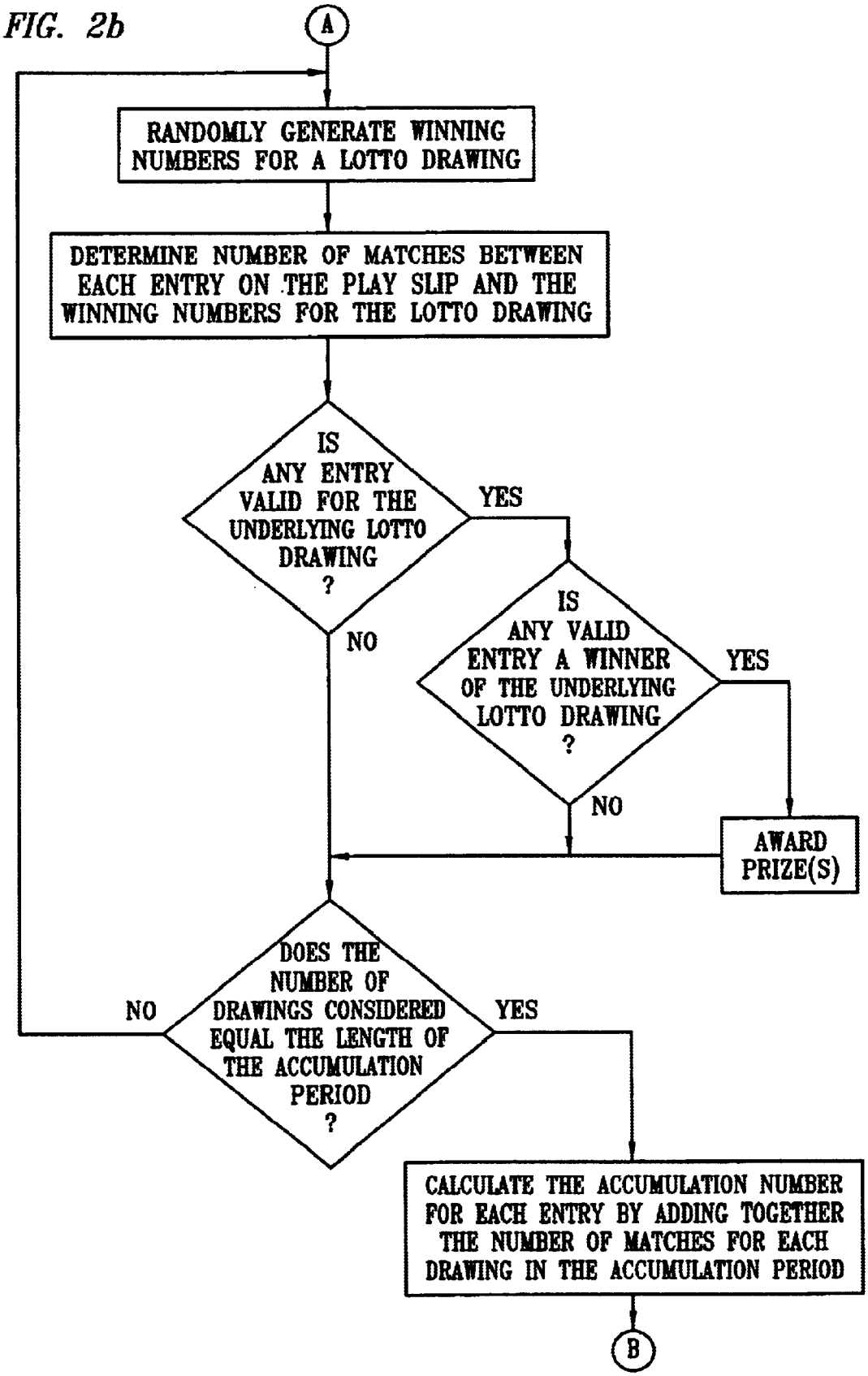
Figure 2C:
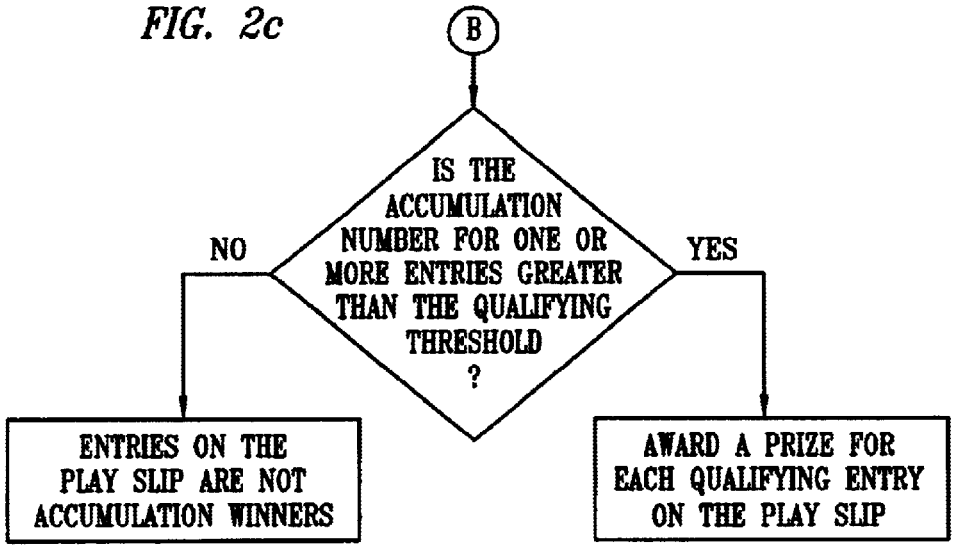

Another variation of the Accumulation Lotto embodiment, depicted in FIGS. 2*a*, 2*b*, and 2*c*, uses each entry in the underlying lottery drawing as a separate entry in the accumulation game. This variation shall be referred to as the "Single Game Module Accumulation Lotto." The single game module is designed to be a simple version of the accumulation game and is based upon the way players play the underlying game in order to increase its acceptance among players.

In the regular lotto game, each group of numbers selected stands alone as a separate entry. While there can be up to five entries on a single play slip, each entry constitutes a separate chance of winning in the specified drawing. By considering each underlying entry to be a separate entry in the accumulation game, the players' frame of reference continues to be based upon the underlying entries individually and does not have to shift to the play slip as a whole for the accumulation game. Since players will continue to view their play slips as a number of individual entries, it will be easier for players to add the accumulation option to their play slips without any confusion. This will likely foster broader initial acceptance of the accumulation variation. Once the accumulation variation is well established and players are comfortable with the basics of the game, lotto operators may desire to add additional lotto offerings using the many other variations that are possible for Accumulation Lotto.

Using each underlying entry separately also improves the player's perception of his chance of winning. If all five possible underlying entries are considered together during the accumulation game, then in a traditional six number lottery there will be 300 possible matches during a ten drawing accumulation period, excluding the possibility of duplicates on the ticket. As discussed above, it is likely that the qualifying threshold would have to be place at around 150 matches. On the other hand, if each underlying drawing is considered separately, the total possible number of matches is 60. Based upon probability calculations, it appears that most games will be won with somewhere between 12 and 18 matches. Not only is the absolute number lower but it also represents close to ¼ of the possible matches, which will appear to players to be more achievable than matching over half of the possible 300 matches using a five entry play slip. Even tickets that do not win will likely be less than 10 matches away from the current leader. Add in the fact that the chances of someone achieving a very high score very close to the beginning of the game are very low, and the result is that players will believe that the vast majority of the potential winnings are easily achievable for the greater part of the accumulation game.

Despite the appearance to the players, the probability of achieving over 12 matches in a regular 6 number lotto over the course of a ten drawing accumulation period is actually quite low. Starting from the basis of a winner in the underlying drawing, who by definition already has 6 matches, it would seem very likely that they would amass at least 12 matches over ten drawings. In order to achieve a total of 18 matches, a winner of an underlying drawing would have to average 1⅓ hits in each of the other 9 drawings. However a review of the winning numbers for any standard 6 number lottery will show that very few of the winning numbers come up often enough in the preceding or following nine drawings to be of much significance. However, if it is decided that the underlying winners gain too much of an advantage in the accumulation game, the accumulation period could be shifted to start on the drawing after the underlying drawing for which the ticket was purchased.

One state's Pick Five lotto game was studied to determine the frequency of recurring numbers. The odds in this Pick Five game compared favorably to the best in any six number games. The pool of available numbers was also significantly smaller than traditional six number games, which use pools ranging from 44–54 numbers. An analysis of a random selection of draws shows that the frequency of the winning numbers with multiple repeats in either the previous nine drawings or subsequent nine drawings is relatively low. Thus winners of the underlying lotto games may have less advantage than it would appear.

The current leaders of the accumulation game are preferably advertised at the point of sale as well as during regularly televised drawings. In Texas, this would mean that the current leaders would be on television six nights a week and on display 24/7 at 16,600 retail outlets, as well as probably reported in the local newspapers along with results of other lotto games. Expanding current retail displays to include the number of matches for the current overall leader as well as the leader for the current period would be relatively simple. This publicity in combination with the low number of matches made by the current leaders will provide additional incentive for players to add the accumulation option to each of the play slips that they purchase.

Considering each underlying entry separately for the accumulation game also will result in a larger pool of potential player and hence larger jackpots without having to add complications to the game. When the underlying entries are considered together for the accumulation game, players can have entries of varying lengths due the number of entries on the play slip, making the resulting Accumulation Lotto much more like Accumulation Keno. While this is not necessarily a bad thing, it adds a level of complexity to the game that may be difficult for a number of players to follow, especially when Accumulation Lotto is first adopted. Instead of simply adding up the total number of matches to determine if they are a winner, players would have to calculate a ratio based upon the number of matches and the number of numbers in their accumulation entry. Of course, the lotto operator could calculate the ratio for the current leader and then display the results as the corresponding number of total matches for each possible entry length. However, this is still significantly more complicated and takes up more display space than a single number for the current accumulation leader. It will also add to confusion as players try to determine what number of underlying entries is at least perceived to provide the best chance of winning. It may also result in a decrease in the number of underlying tickets sold because the lower absolute numbers for the ticket with fewer underlying entries will likely be perceived as being more achievable than the higher numbers required for a ticket with more underlying entries, despite the fact that the probabilities would be equal for all length tickets.

Alternatively, as was done in the second embodiment described above, the accumulation game can be restricted to those players who have a certain number of underlying entries, such as all five possible entries per play slip. This avoids the confusion and complications associated with multiple length entries in the accumulation game. However, it also prevents a large number of players from playing the accumulation variant. While players who normally play four entries per play slip might be willing to add the fifth entry to be able to add the accumulation option to their ticket, players who normally only play one, two, or even three entries per play slip are much more likely to simply forgo the accumulation option altogether. This results in a smaller player pool with resulting smaller payoffs and jackpot, which itself will further discourage players from participating in the Accumulation Lotto game.

By considering each underlying entry separately for the accumulation game, the lotto operator gets the best of both worlds. Every player has the option and incentive to add the accumulation game to their play slip, regardless of the number of entries that it contains. While players who add the accumulation option to a play slip containing more underlying entries would have additional chances to win, their odds of winning for each entry are no greater than players who only have one underlying entry on their play slip. In addition, the game is kept as simple as possible and players only have to count up the total number of matches for each entry to determine if they are a winner. This has the added advantage that players do not have to change their playing habits at all, since they are already used to considering each entry separately when determining if they have won anything. As a result, this is the best option for introducing an accumulation variation to a traditional lotto.

Preferably, the fee for adding the accumulation game to the play slip will be the same regardless of the number of independent entries that are present on the slip. This lowers the effective price of adding the accumulation game per entry, for play slips that have additional entries. For example, in a standard $1 per entry game with five possible entries per play slip, adding the accumulation game for the entire play slip would cost $1. This translates to $1 per entry for play slips that have only a single underlying entry. However, the cost per entry drops to 50¢ per entry for play slips containing two entries, 33¢ per entry for three entries, 25¢ per entry for four entries, and 20¢ per entry for five entries. This pricing structure results in an increased incentive to add additional entries in the underlying game, since the player is gaining additional entries in the accumulation game without having to pay any additional money, other than the cost of the underlying entry. While this may discourage single entry players from adding the accumulation option, these players are not likely to increase their wager in the underlying game anyway. On the other hand, a single fee per play slip, will encourage players who already have multiple entries in a single drawing to, at a minimal additional fee, add the accumulation game to all of their entries, thereby substantially increasing their chance of winning.

In practice, the Single Game Module for Accumulation Lotto might look like the following. A 26-week long Single Game Module Accumulation Lotto can be set up with drawings twice a week, resulting in 52 drawings over the course of the game. One through five entries can be played on a single play slip and the cost of adding the accumulation option to a play slip is one dollar, regardless of the number of entries on the play slip. The accumulation period begins on the underlying drawing for which the entries were purchased and continues for ten drawings. Entries are split into one of six groups based upon the drawing on which their accumulation period began. Five periods containing seven drawings each and one period containing eight drawings are set up with accumulation entries assigned to one period based upon the first drawing of the entry's accumulation period. As a result, tickets whose accumulation period started on the last drawing of the sixth period will have the final drawing of their accumulation period fall on the 52nd and final drawing of the game. Tickets whose accumulation period begins the drawing after the last drawing of the sixth period will be part of the first group in the next Accumulation Lotto game, even though the 44–52 drawings are still necessary to finish up the ten drawing accumulation period of tickets in the sixth group.

For purposes of this example, it is assumed that there are 1.5 million play slips per drawing in the underlying lottery and that each play slip averages four entries. This results in 6 million accumulation lotto entries per drawing (1.5 million slip×4 entries per slip), assuming that all players add the accumulation option to each of their play slips. At the end of the game there will be $78 million dollars in the Accumulation Lotto pool (1.5 million slips×$1 per slip×52 drawings). Assuming a 55% payout, there will be almost $43 million available for prizes over the course of the accumulation game. While the previous examples assume a 65% payout, many lottery commissions have reduced the payout percentage since those examples were calculated, so 55% has been used to provide a more conservative estimate of available funds for prizes. This prize pool can be divided up as follows: $28 million or 65% for the end-of-game grand prices, $3 million or 7% for the periodic prizes, and $12 million or 28% for payouts to qualifiers.

Figure 1B:
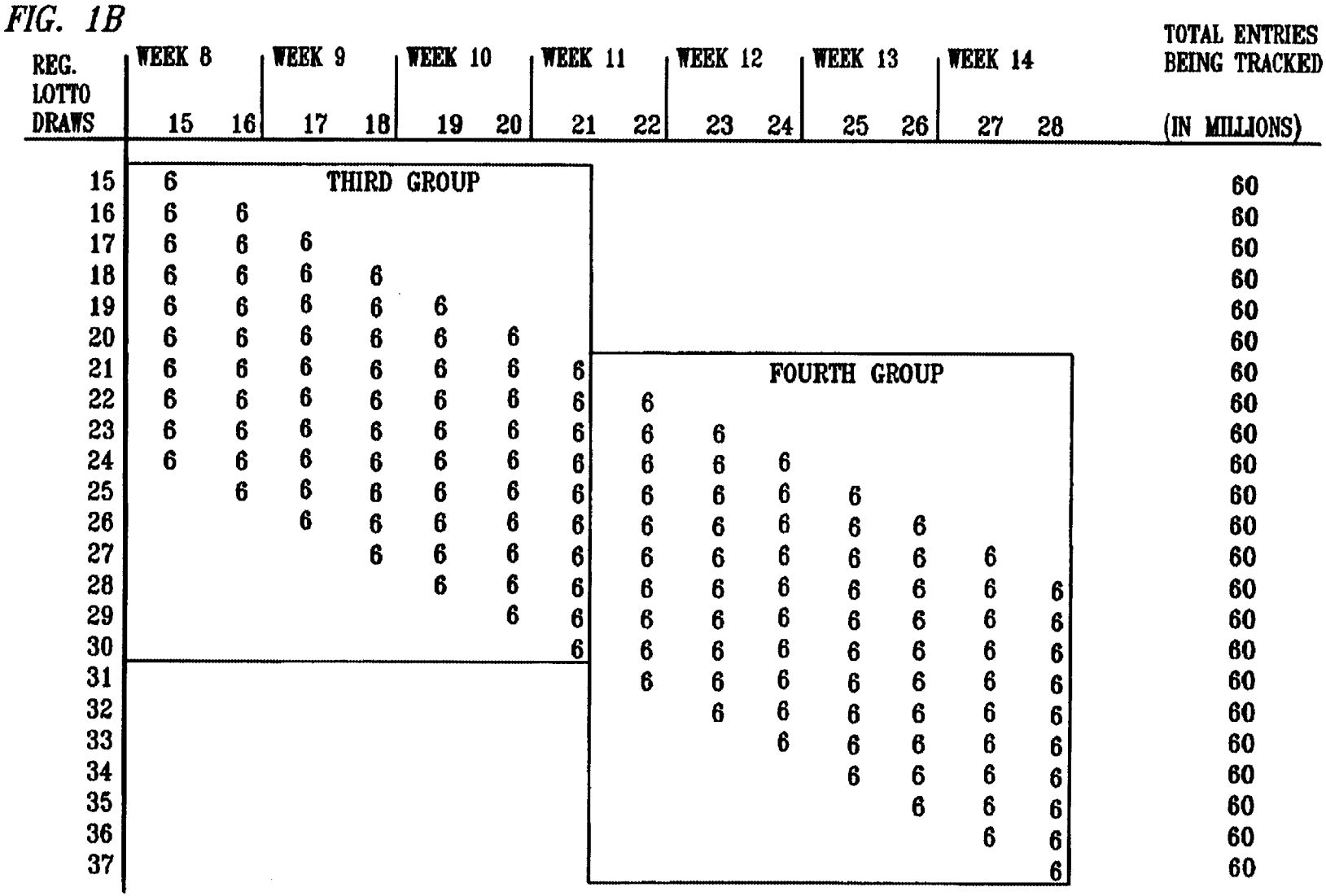
FIG. 1B is a portion of a table of an example of Single Game Module Accumulation Lotto depicting the accumulation periods making up the third and fourth groups.
Figure 1C:
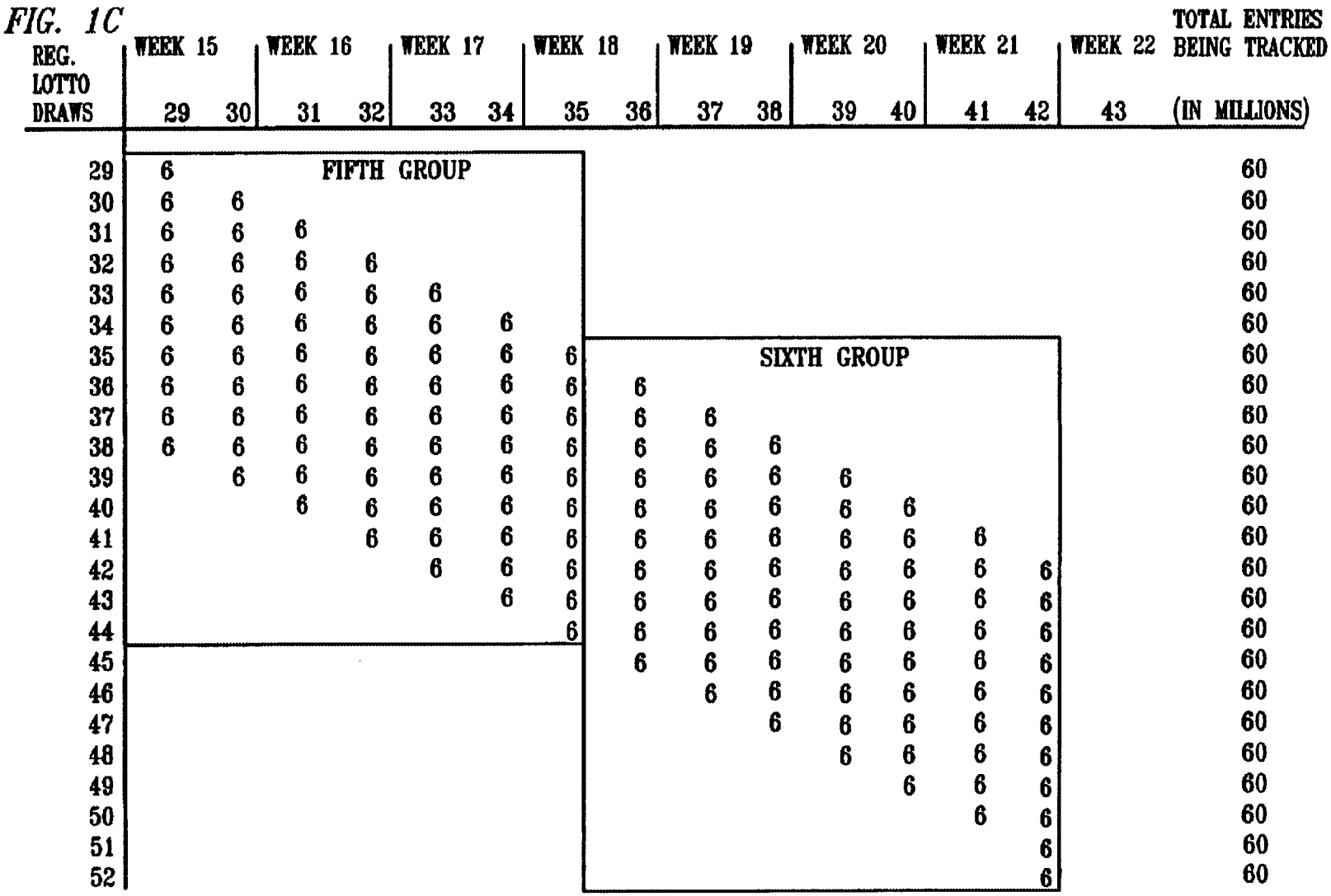
FIG. 1C is a portion of a table of an example of Single Game Module Accumulation Lotto depicting the accumulation periods making up the fifth and sixth groups.

This example is depicted in tabular form in FIGS. 1A, 1B, and 1C, which collectively show the mechanics and tracking requirements of the example accumulation lotto game. The columns represent each accumulation period identified by the regular lotto draw that it starts on and the rows represent the regular lotto drawings used for the accumulation game. Based upon the earlier assumption that there are 1.5 million play slips per drawing and that the average play slip has four entries, there will be six million entries that are considered during the first drawing and that need to be tracked at that time. This is represented by the 6 located in the row corresponding to the first drawing. The total number of entries "in play" increases to 12 million for the second drawing, as shown in the second row of FIG. 1A, because the six million entries purchased for the first drawing must still be considered and tracked as well as the six million entries purchased for the second drawing. The number of entries that must be considered and tracked will increase by six million for each subsequent drawing until it reaches 60 million for the tenth drawing. After that, the number of entries whose accumulation period has finished and thus no longer need to be tracked offset the number of entries whose accumulation period starts on each subsequent drawing. Therefore, the total number of entries that need to be tracked will generally not be significantly higher than 60 million at any point during the game. Of course the number of play slips sold for each drawing and the number of entries on each play slip will vary from drawing to drawing so the number depicted in FIGS. 1A–1C are only estimates. In addition, qualifying entries will have to be tracked until the end of the accumulation period of the last entries in the group and entries winning the periodic prizes will have to be tracked until the end of the game, however, this will not add substantially to the tracking requirement.

For purposes of the single game module herein, we have chosen a 52 draw total duration for the game illustration and based our calculations of pool and prize monies on the premise that all monies paid for tickets during all 52 games will be part of the total pool, even though tickets purchased during the later stages of the game will carry-over into the next game because their ten draw accumulation period will not have concluded by the 52nd drawing. The 52 draw game duration lends itself neatly to both a six-month game and a calendar year game. Dividing the drawings into six groups results in a periodic prize being awarded about once every month.

In order to avoid having a nine draw break at the end of each game where the accumulation period of ticket in the prior game are completed without any new accumulation period beginning, there will always be nine draws that must be carried over to the next game. The current example rolls these draws into the next game but keeps the revenue from those drawings in the first game. This will ensure 52 drawings worth of revenue for each game, which helps maintain a large prize fund to maximize player's participation in the game. Alternatively, the revenue from these draws could be rolled over to the next game along with the entries, however, this would reduce the available prize fund for the first game from $43 million to just over $33 million, thereby significantly affecting the prize structure. In practice, lottery operators may choose from a range of options and permutations in implementing the Single Game Module. Some may vary the number of draws for each periodic prize, extend or reduce the overall length of the game, or choose to carry forward the funds from entries that roll over to the next game rather than include them in the game in progress at the time the tickets were purchased. Even with a single game module, in the lottery environment no two accumulation game offerings may be identical but all will share the same fundamental and basic characteristics.

Figure 3A:
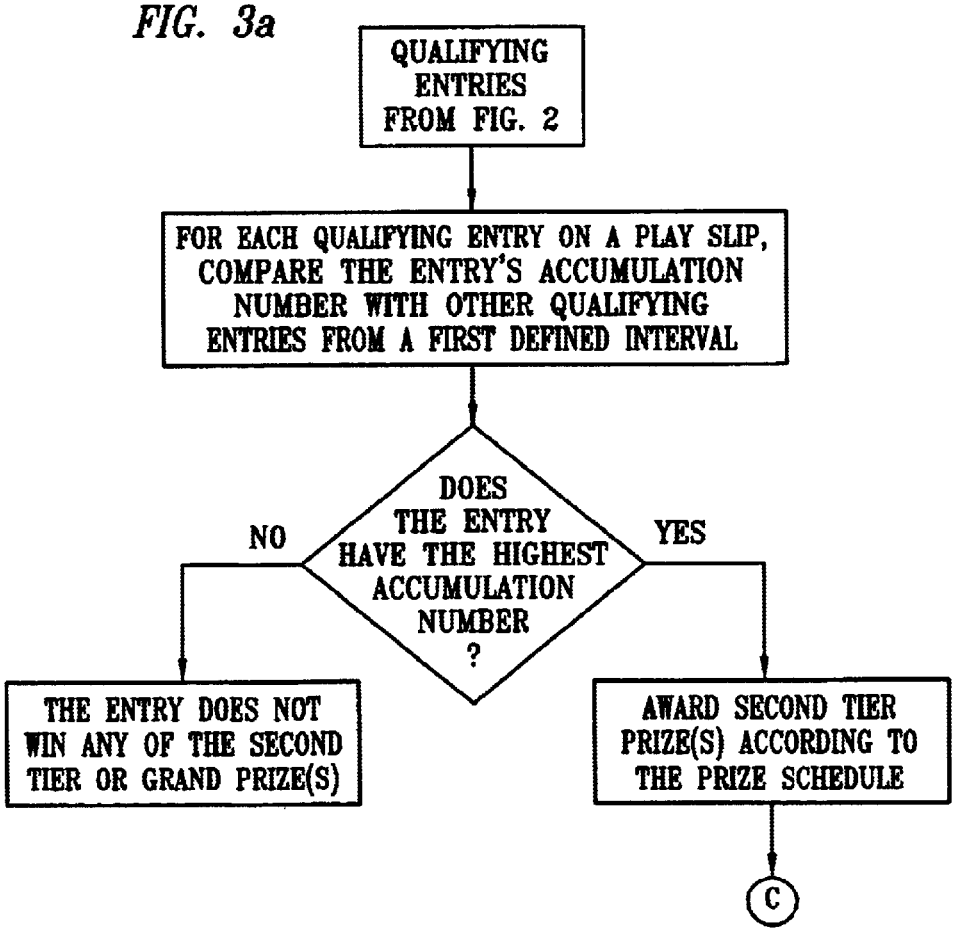
FIGS. 3*a* through 3*b* is a flow chart depicting another embodiment of the current invention where the qualifying entries during set periods compete for additional prizes.
Figure 3B:
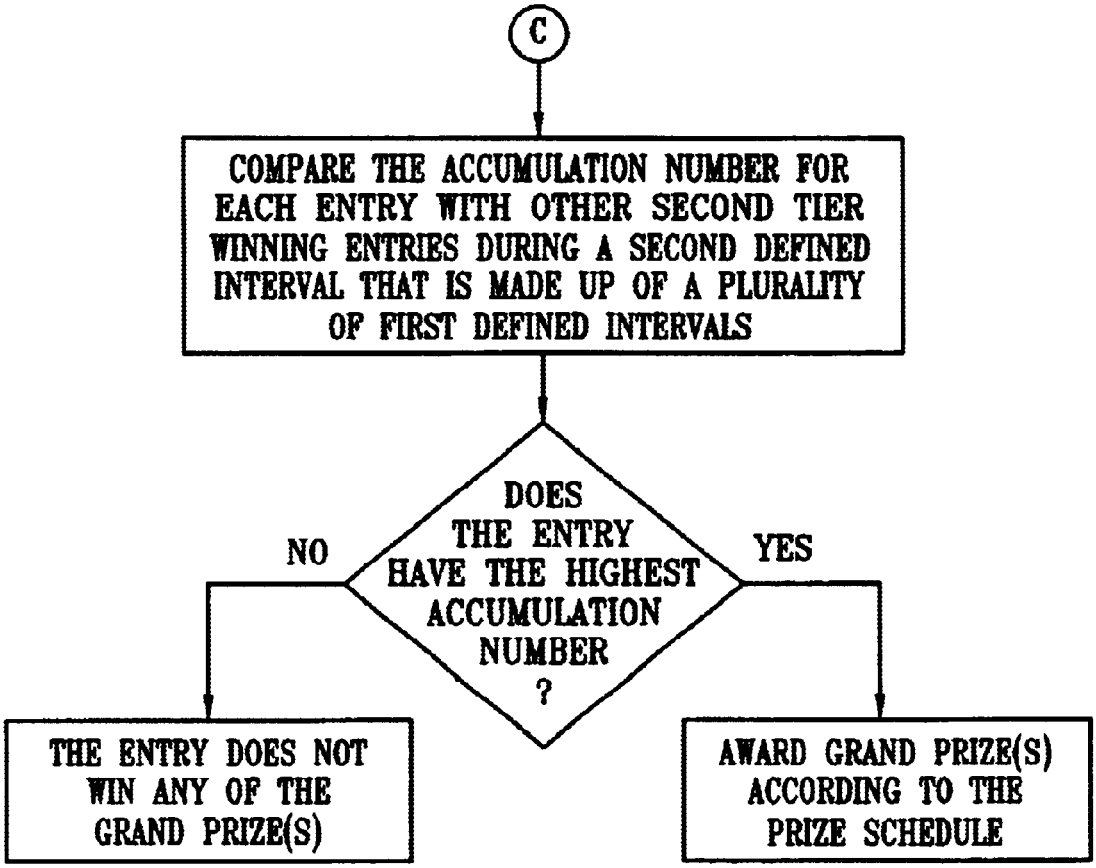

As depicted in FIGS. 3*a* and 3*b*, a qualifying prize is awarded at the end of an entry's accumulation period if the total number of matches exceeds the qualifying level. The qualifying level and the amount of the prize will vary depending upon the percentage of tickets the lotto operator wants to qualify and the overall size of the prize pool that is allocated for qualifying prizes. The number of qualifying tickets will also have an effect on the number of tickets that need to be tracked at any one time. Short term trends and aberrations in consecutive draws can distort probabilities to a significant extent; e.g. in one ten draw span, there may be no winners of the underlying lottery games; in another, there may be multiple winners of several, each creating a base of six numbers toward the qualification threshold. Depending upon database analysis of the lottery drawing history, and the intent of the operator, the threshold for a 49 number lottery may be as low as 10 or 11 hits or as high as 12 or 13. Payouts to Qualifiers at these levels could likely be set in the range of $200 to $650. The qualifier prizes will be distributed on an ongoing basis as the accumulation period for each entry ends.

Periodic prizes are also awarded for the highest number of matches in each of the six periods identified in FIGS. 1A through 1C. Again, the number of prizes and amounts can be adjusted as desired by the lotto operator. In this case, $3 million was allocated for periodic prizes, providing $500,000 for each of the six periods. Consequently, it is recommended in this example that the periodic prizes are tiered down from $250,000 (i.e. $250,000 for the highest number of matches, $125,000 for the second highest, $75,000 for the third highest, and $25,000 for the fourth and fifth highest). The periodic prizes will be awarded during the seventeenth drawing and then every seventh drawing thereafter when the last entries for each period have finished their ten drawing accumulation period. As a result, after the first eight weeks, periodic prizes will be awarded every three and a half weeks over the course of the game.

The grand prizes will be awarded after the 52nd draw, when the last tickets complete their accumulation period. There has been $28 million allocated for the end-of-game prizes. This is preferably tiered down from a suitably attractive grand prize, such as $25 million as the grand prize, $2 million for second place, $500,000 for third place, and $250,000 for fourth and fifth places. These prizes are preferably fixed and announced at the beginning of the game. This provides incentive, even for players early in the game, to add the accumulation option to every play slip, because it is known that the grand prizes will be awarded at the end of the game without anyone having to achieve a near impossible number of matches.

In some cases a more pari-mutuel structure is desired by the lottery commission or may be required by the legislature. The preferred way to obtain this is by adjusting the level of the payouts for the next Accumulation Lotto game based upon the actual participation in the previous game. This maintains the incentive structure of fixed prizes while providing a more pari-mutuel structure. Alternatively, the end-of-game prizes can be set as a progressive jackpot with a minimum that increases over the course of the game depending upon the player participation. Making the prizes progressive will reduce one of the key advantages of Accumulation Lotto, namely the large attractive jackpot that is guaranteed at the very beginning of the game to be awarded to the entry with the most matches. However, a progressive jackpot may be necessary at least initially for some lottery commissions who may be afraid to guarantee high jackpots for a game without a proven track record in the jurisdiction. In this case, it is preferred that the minimum jackpot level be set as high as possible to provide more incentive for players to add the accumulation option early in the game as well as later when the jackpot has had a chance to grow.

The major attraction for players is that it is guaranteed that both the periodic prizes and the end-of-game grand prizes are awarded. Unlike the regular lotto game, players do not have to get a perfect or near perfect match in order to win a substantial sum. All that is required is that the player obtains more matches with a single entry than other players. In this way, player interest will remain high from the very beginning as opposed to a standard lottery game where interest only begins to increase after the jackpot passes a certain threshold.

The availability of Accumulation Lotto will also serve to increase interest in the underlying lottery game. In the single game module, each entry in the accumulation game is linked to an entry in the underlying lottery. In addition, the fee for adding the accumulation option to a play slip is the same regardless of the number of underlying entries on the slip. Finally, since the periodic prizes are guaranteed to be awarded and players are only competing against other players, the chances of winning one of the periodic prizes is greater during periods when fewer entries are received, such as is likely to occur when the underlying jackpot is small. Therefore, players will have the incentive to increase the number of underlying entries made to improve their odds to win the guaranteed Accumulation Lotto prizes, even during periods when the underlying lotto jackpot is not large enough to be attractive on its own.

Logistically, the Single Game Module Accumulation Lotto is similar to the Accumulation Lotto embodiment discussed above. All that is required is that the ticket indicate that the accumulation option was selected and preferably the last drawing of the accumulation period. Lotto tickets already indicate the drawing for which they apply and this drawing also serves as the first drawing of the accumulation period. Lottery operators may also desire to indicate which period the ticket falls in to make it easier for players to identify which periodic prize they are competing for. The unique ID that is already present on most lotto tickets can also link the ticket to its current number of total matches in a computer database. Players can present their tickets for scanning at the end of the accumulation period to see if they've won or even during the accumulation period to track their progress. If desired, online access can also be provided on the lotto commission's website where players can enter their ticket's unique ID to track their current total number of matches and see if they have won. The total number of matches can either be calculated on the fly by the system or be updated after each drawing and saved in the database based upon the unique ID of the play slip.

The necessary tracking and verification functions can most likely be accomplished using the current lottery systems. Only a small percentage of the total number of entries at any given time need to be tracked, as exemplified in FIGS. 1A through 1C. After an entry's accumulation period is over, it no longer needs to be tracked. Similarly, after a period has completed and the periodic prizes awarded, all entries from that period that did not win a periodic prize can be purged from the system. Consequently, with a ten drawing accumulation period, there are only approximately entries from ten drawings that need to be tracked, plus a few qualifiers and periodic winners that need to be tracked for the remainder of the period or game, respectively. In the above single game module, this results in at most 60 million entries being tracked at any given time. The number of new entries that must be tracked are generally offset by the number of entries that no longer need to be tracked because they are no longer in the running for additional prizes.

The functions required by Accumulation Lotto will not require significant expenditures in new equipment for lottery commissions. Most likely, the necessary requirement can be met by the current capabilities of lottery systems with only minor modifications and perhaps some additional storage space for the electronic records. Tickets already contain check boxes for players to choose the type of payout or have the same numbers entered into a consecutive number of underlying drawings. An additional box could be added to choose the accumulation option. Most lottery systems also have the necessary software to identify, handle, and store tickets that the player desires to have entered into a number of consecutive underlying drawings. This feature can likely easily be adapted to provide most if not all the required features for the Single Game Module Accumulation Lotto.

At worst, a simple management program will be required to overlay the standard system, query the master database for the necessary data regarding the accumulation entries and drawing results, and report the qualifying and winning ticket IDs back to the main system for payout processing. This overlay program can most likely be run on the same equipment as the standard lotto program. The accumulation software would be simple enough to run on a high-end desktop, if necessary, with an array of hard drives for the necessary record storage. This is especially true since none of the functions required for the accumulation game are time sensitive or have to be carried out in real time.

Just like Accumulation Keno and Accumulation Lotto, any tickets that win during the underlying drawing must have some indication when they have been paid in order to prevent players from cashing in multiple times on the same ticket. This can be done by taking the ticket and issuing the player a copy, such as by using the duplicate ticket function built in to most lottery systems. The original ticket could also simply be marked in some manner when the payout is made and returned to the player. Finally, the main system could simply record that the ticket with a particular unique ID has been paid for the underlying drawing and the ticket could be returned to the player. A similar approach for indicating whether a ticket has been paid for a particular prize level will be required for tickets that achieve the qualifying threshold as well as those that win periodic prizes.

It is preferable that the lotto agency records the identity of any player that achieves a set level, such as the qualifying threshold, when the payout is made for the qualifying ticket. This will ensure that the identity of any potential winner of a major prize is already in the system as well as the ticket's unique ID. The identities of those who do not win the relevant periodic prize will then be deleted from the system, so there will only be a manageable number of records in the system at any one time. This system will enable the lottery commission to know at the end of any relevant period and at the end of the game, the identity of the winners, thereby simplifying and speeding up the prize award process and eliminating instances of fraud. This system would not add any significant amount of complexity to the administration of the accumulation game since the IRS already mandates that the identities of anyone who wins $600 or more be recorded for tax purposes.

The above description of certain embodiments are made for the purpose of illustration only and are not intended to be limiting in any manner. Other alterations and modifications of the preferred embodiment will become apparent to those of ordinary skill in the art upon reading this disclosure, and it is intended that the scope of the invention disclosed herein be limited only by the broadest interpretation of the appended claims to which the inventor is legally entitled.

What is claimed is:

1. A method of conducting a lottery-style game of chance comprising the steps of:

having players each select a first set of numbers of a fixed length constituting an entry in said game, said first set of numbers also constituting an entry in a drawing for a Lotto game;

randomly generating a plurality of second sets of numbers of said fixed length, wherein each said second set of numbers is provided by a set of winning numbers for a drawing in said Lotto game;

defining an accumulation period for each said first set of numbers comprising a defined consecutive number of said plurality of second sets of numbers;

comparing said first set of numbers to each of said second sets in said accumulation period to identify matches between said sets of numbers;

calculating an accumulation number for each said entry by adding up the matches between said first set of numbers and said second sets of numbers in said accumulation period;

awarding a grand prize for said first set of numbers with the highest accumulation number during said game.

2. The method of claim 1 wherein said player selects said first set of numbers by requesting said first set be randomly generated.

3. The method of claim 1 wherein said accumulation period is ten consecutive second sets of numbers.

4. The method of claim 1 wherein said accumulation period begins with said second set of numbers provided by said set of winning numbers in said Lotto game for which said first set constituted an entry.

5. The method of claim 1 further comprising, awarding a first prize for each said first set of numbers where said accumulation number for said first set of numbers is above a threshold.

6. The method of claim 5 further comprising, awarding a second prize after a defined interval, said defined interval being shorter than said game, for at least said first set of numbers with the highest accumulation number during said first defined interval.

7. The method of claim 5 wherein additional said second prizes are awarded for subsequent said defined intervals.

8. The method of claim 6 wherein only players winning said first prize are eligible to win said second prize or said grand prize.

9. The method of claim 1 further comprising charging a single entry fee for said game for each play slip, wherein said play slip may contain more than one said entry.

10. The method of claim 9 where each said entry slip contains no more than five entries.

11. A method of conducting a lottery-style game of chance comprising the steps of:

having players each select a first set of numbers of a fixed length constituting an entry in said game and also constituting an entry in a drawing for a Lotto game;

charging a single entry fee for said game for each play slip, wherein said play slip may contain more than one said entry;

randomly generating a plurality of second sets of numbers of said fixed length, wherein each said second set of numbers is provided by a set of winning numbers for a drawing in said Lotto game;

defining an accumulation period for each said first set of numbers comprising ten consecutive number of said plurality of second sets of numbers;

comparing said first set of numbers to each of said second sets in said accumulation period to identify matches between said sets of numbers;

calculating an accumulation number for each said first set of numbers by adding up said matches between said first set of numbers and said second sets of numbers in said accumulation period;

awarding a grand prize to at least one of said players whose entry has the highest accumulation number during said game.

12. The method of claim 11 further comprising, awarding a first prize if said accumulation number for said first set of numbers is higher than a qualifying threshold.

13. The method of claim 12 further comprising, awarding a second prize after a first defined interval for at least said first set of numbers having the highest accumulation number during said first defined interval.

14. The method of claim 11 further comprising, awarding additional said second prizes for subsequent said first defined intervals.

15. The method of claim 14 wherein only players winning said first prize are eligible to win said second prizes or said grand prize.

16. The method of claim 11 wherein said accumulation period begins with said second set of numbers provided by said set of winning numbers in said Lotto game for which said first set constituted an entry.

17. The method of claim 11 wherein each said entry slip contains no more than five entries.

18. The method of claim 11 wherein said player selects said first set of numbers by requesting said first set be randomly generated.

19. A method of conducting a lottery-style game of chance comprising the steps of:

having players each select a first set of numbers of a fixed length constituting an entry in said game, said first set of numbers also constituting an entry in a drawing for a Lotto game;

charging an entry fee for said game for each entry slip, wherein said entry slip may contain up to five entries;

randomly generating a plurality of second sets of numbers of said fixed length, wherein each said second set of numbers is provided by a set of winning numbers for a drawing in said Lotto game;

defining an accumulation period for each said first set of numbers comprising ten consecutive sets of said plurality of second sets of numbers and beginning with said winning numbers in said Lotto game for which said first set constituted an entry;

comparing said first set of numbers to each of said second sets in said accumulation period to identify matches between said sets of numbers;

calculating an accumulation number for each said first set of numbers by adding up said matches between said first set of numbers and said second sets of numbers in said accumulation period;

awarding a first prize if said accumulation number for said first set of numbers is higher than a qualifying threshold;

awarding a second prize after a first defined interval for at least said first set of numbers having the highest accumulation number during said first defined interval;

awarding additional said second prizes for subsequent said first defined intervals;

awarding a grand prize to at least said first set of numbers with the highest accumulation number during said game;

wherein only first set of numbers winning said first prize are eligible to win said second prizes or said grand prize.

* * * * *